United States Patent [19]

Inman

[11] 4,000,531

[45] Jan. 4, 1977

[54] BOX SPRING ASSEMBLY AND GRID

[75] Inventor: Harold W. Inman, Birmingham, Mich.

[73] Assignee: Lear Siegler, Inc., Santa Monica, Calif.

[22] Filed: Feb. 17, 1976

[21] Appl. No.: 658,558

[52] U.S. Cl. ..... 5/267; 5/260; 5/351

[51] Int. Cl.[2] ..... A47C 23/02

[58] Field of Search ..... 5/246–248, 5/255, 259 R., 259 B, 207, 351, 354, 260

[56] References Cited

UNITED STATES PATENTS

| | | | |
|---|---|---|---|
| 3,722,013 | 3/1973 | Surletta | 5/351 |
| 3,827,090 | 8/1974 | Roe | 5/351 |
| 3,833,948 | 9/1974 | Surletta et al. | 5/247 |
| 3,835,485 | 9/1974 | Klicki | 5/351 |
| 3,953,903 | 4/1976 | Lawrence et al. | 5/267 |

*Primary Examiner*—Casmir A. Nunberg
*Attorney, Agent, or Firm*—Reising, Ethington, Barnard, Perry and Brooks

[57] ABSTRACT

A rectangular box spring assembly of the disclosure includes a grid of crossing wires whose lateral edges have an improved construction in combination with formed wire springs that support the edges of the grid on lateral side members of a lower frame. Each lateral edge of the grid includes a pair of inboard and outboard longitudinally extending wires that are of a heavier gauge than the other wires of the grid. Each formed wire spring on the side frame members includes a pair of fishmouth sections extending upwardly from the frame and a connecting section that interconnects the fishmouth sections and supports the adjacent grid edge. The connecting section of each spring includes an inboard main portion and outboard end portions connected to the main portion. The outboard heavier gauge wire at each lateral grid edge is secured to the outboard end portions of the spring connecting sections to locate the grid. Additionally, end border wires of the assembly include bent end portions that overlap the outboard heavier gauge wires and have extreme ends that are turned to also overlie the inboard heavier gauge wire. The end portions of each end border wire are secured to the outboard heavier gauge wires by clips and to one of the laterally extending wires of the grid. Formed wire springs on end frame members support the end border wires and have a construction like the formed wire springs on the side frame members. Endmost laterally extending wires at each end of the grid are preferably secured to the inboard main portions of the connecting sections of the adjacent springs. Also, the outboard heavier gauge wires at the lateral edges of the grid are preferably shorter than the inboard heavier gauge wires.

12 Claims, 3 Drawing Figures

BOX SPRING ASSEMBLY AND GRID

BACKGROUND OF THE INVENTION

1. Field of the Invention

The present invention relates to a box spring assembly for bedding usage and to an improved edge construction of the assembly.

2. Description of the Prior Art

Prior art box spring assemblies have included wire grids supported by springs on a lower frame. See for example, U.S. Pat. Nos. 3,827,090, 3,833,948, 3,833,949, 3,855,651, and 3,869,740. The grids of such assemblies must have lateral edges that are somewhat more rigid than the central portion of the grid. A single border wire at the periphery of the grid is conventionally utilized to provide the required edge stiffness.

SUMMARY OF THE INVENTION

The present invention relates to a rectangular box spring assembly having an improved edge construction. A grid of the assembly includes laterally and longitudinally extending wires that cross each other. Each lateral edge of the grid includes a pair of longitudinally extending wires of a heavier gauge than the other wires of the grid. These heavier gauge wires are located at inboard and outboard locations in a laterally spaced relationship at each lateral grid edge. Formed wire springs mounted on lateral side members of a lower frame of the assembly each include a pair of fishmouth sections extending upwardly from the frame and a connecting section that interconnects the fishmouth sections. Each connecting section includes an inboard main portion and outboard end portions connected to the main portion and the fishmouth sections. Clips secure the outboard end portions of the spring connecting sections to the outboard heavier gauge wires to provide securement of the grid to the springs.

Additionally, end border wires of the assembly include bent end portions that overlap the outboard heavier gauge wires and have extreme ends that are turned to also overlie the inboard heavier gauge wires. Clips secure the bent end portions of each end border wire to the outboard heavier gauge wires and to a laterally extending wire of the grid.

End frame members of the lower frame mount formed wire springs of a construction like the formed wire springs on the side frame members. The connecting sections of the springs on the end frame members are secured to the endmost laterally extending wire at each end of the grid. Preferably, clips secure the endmost laterally extending wires directly to the inboard main portion of the springs on the end frame members and also secure the end border wires to the outboard end portions of the connecting sections on these same springs. Also, the outboard heavier gauge wires at the lateral sides of the assembly are shorter than the inboard heavier gauge wires.

The objects, features and advantages of the box spring assembly disclosed by the present invention will be readily apparent from the following detailed description of the preferred embodiment taken in connection with the accompanying drawings.

DETAILED DESCRIPTION OF THE PREFERRED EMBODIMENT

Figure 1:
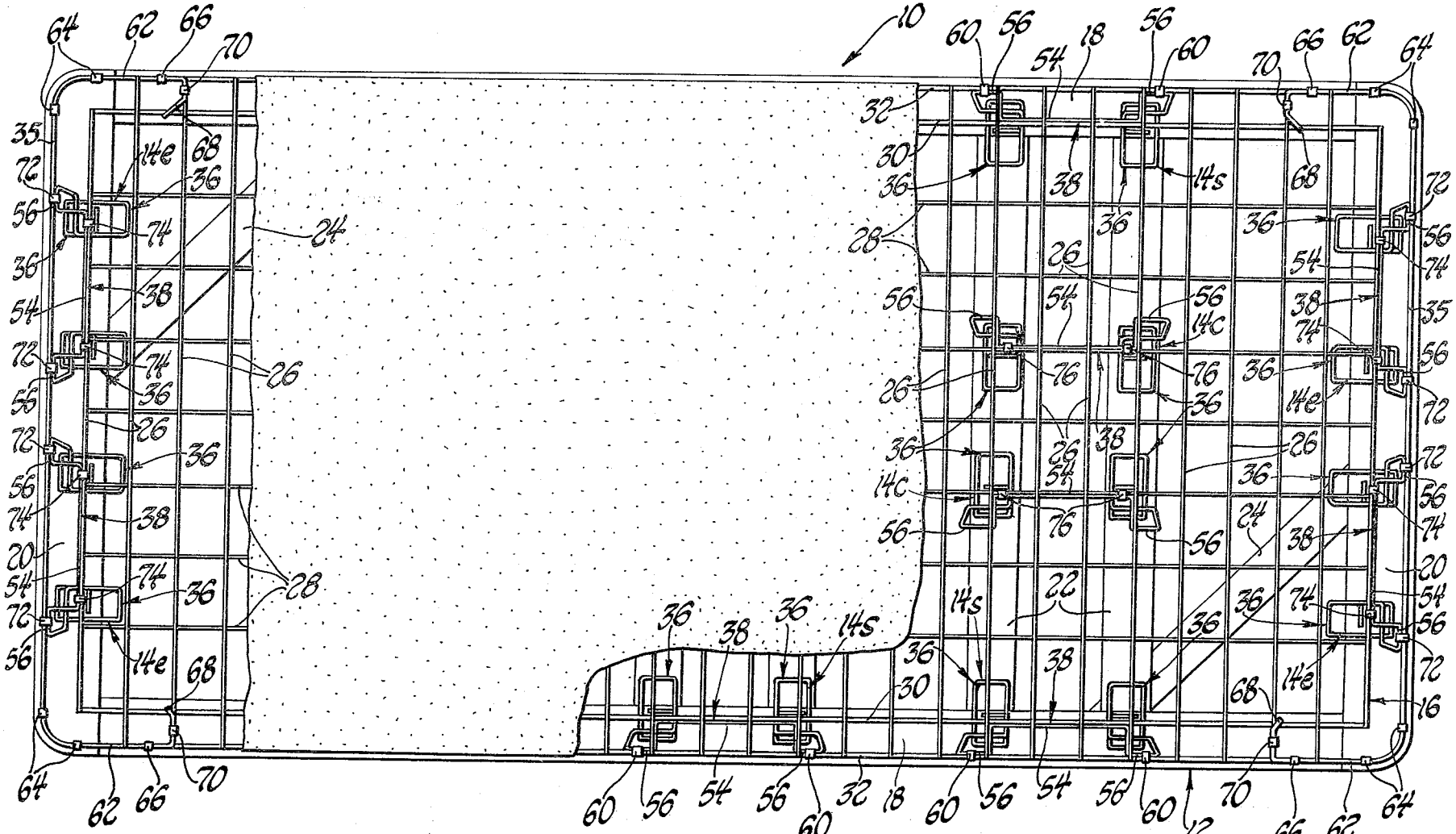
FIG. 1 is a top plan view of a box spring assembly that embodies the present invention.

Referring to FIG. 1 of the drawings, a box spring assembly that embodies the present invention is generally indicated by reference numeral 10 and includes a lower rectangular frame 12, formed wire springs 14*s*, *e*, and *c*, mounted on the frame, and an upper wire grid 16 supported on the frame by the springs. The springs 14*s* are associated with the lateral side edges of the assembly and are mounted on lateral side members 18 of the lower frame. End members 20 at the opposite longitudinal ends of the assembly cooperate with the side members 18 to form a rectangular configuration and also support the springs 14*e* associated with the longitudinal ends of the assembly. Slats 22 of the frame extend laterally between the side frame members 18 and support the springs 14*c* associated with the central portion of the assembly. Diagonal braces 24 extend between the side members 18 and the end members 20 of the frame at diagonally opposed corners of the assembly to provide reinforcement.

The wire grid 16 of the box spring assembly includes a plurality of laterally extending wires 26 and a plurality of longitudinally extending wires 28 that are welded to each other at their crossing junctures. Each lateral edge of the wire grid also includes a pair of heavier gauge wires 30 and 32 that are respectively located at inboard and outboard positions in a laterally spaced relationship with respect to each other. These heavier gauge wires are also welded to the laterally extending wires 26 at their perpendicular junctures. The lighter gauge wires 26 and 28 of the grid are preferably made from wire stock of a 12, 13 or 14 gauge and thus have a diameter between 0.078 and 0.105 inches. The heavier gauge wires preferably are made from wire of 8 or 9 gauge and thus have a diameter between 0.148 and 0.162 inches. Each longitudinal end of the grid 16 also incorporates an end border wire 35 that is mounted on the associated frame end member 20 by the adjacent springs 14*e*. These end border wires 35 are of the same gauge as the heavier gauge wires 30 and 32.

Figure 2:
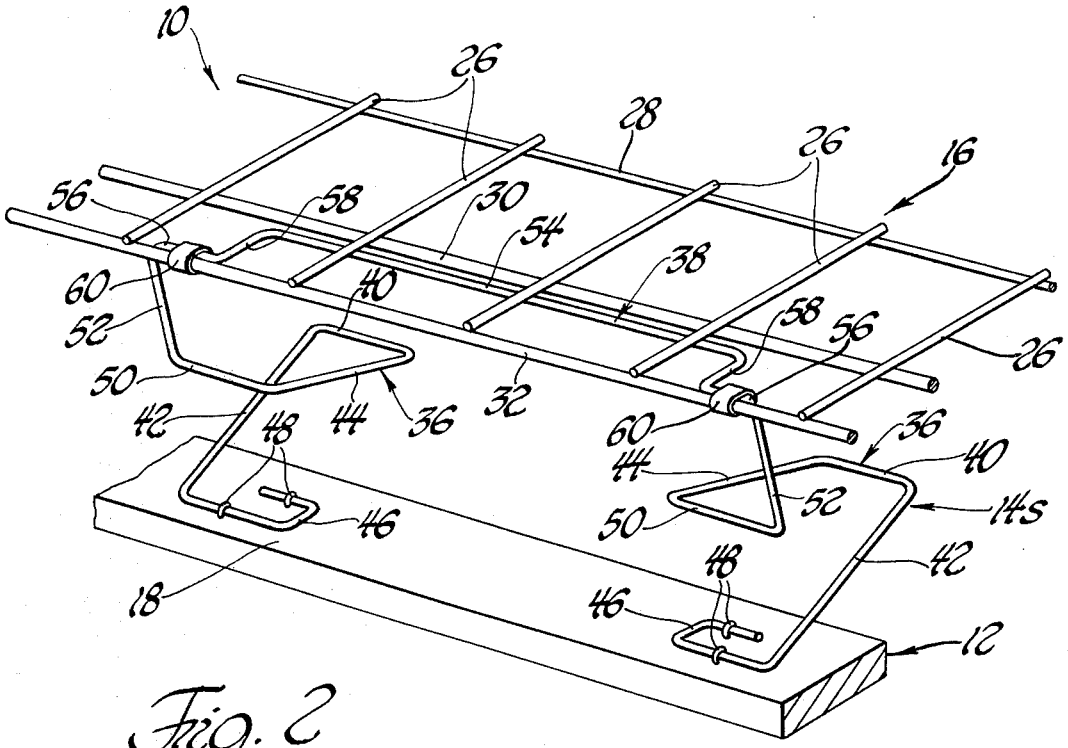
FIG. 2 is a perspective view of a lateral edge portion of the assembly at a location intermediate its longitudinal ends.

The formed wire springs 14*s*, *e* and *c* have a construction identical to each other and their different letter references are intended only to indicate that these springs are respectively associated with the sides, ends and central portion of the assembly. FIG. 2 shows one of the springs 14*s* associated with the side of the assembly and is thus illustrative of the construction of the other springs as well. As can be seen, each spring includes a pair of fishmouth sections 36 extending upwardly from the adjacent lateral side frame member 18 and a connecting section 38 that interconnects the fishmouth sections. Each fishmouth section includes a torsion bar 40 whose opposite ends are connected to downwardly and upwardly inclined spacer bars 42 and 44. The lower ends of the downwardly extending spacer bars 42 are integrally joined with J-shaped attaching sections 46 of the springs which are secured by staples 48 to the associated side frame member 18. The upper ends of the upwardly extending spacer bars 44 are integrally joined with torsion bars 50 that are also integrally connected with height spacer bars 52. An inboard main portion 54 of the spring connecting section 38 is connected to outboard end portions 56 of the connecting section by outwardly extending wire legs 58.

As seen by combined reference to FIGS. 1 and 2, the outboard end portions 56 of the connecting sections 38 of springs 14*s* are secured to the outboard heavier gauge wires 32 by clips 60. The inboard main portions 54 of these spring connecting sections 38 are positioned adjacent the inboard heavier gauge wires 30 due to the securement provided by clips 60. Springs 14*s* resiliently support the lateral edges of wire grid 16 on the lower frame 12 and the two heavier gauge wires 30 and 32 bridge the gap between these springs to maintain a firm edge support along the total length of the assembly.

Figure 3:
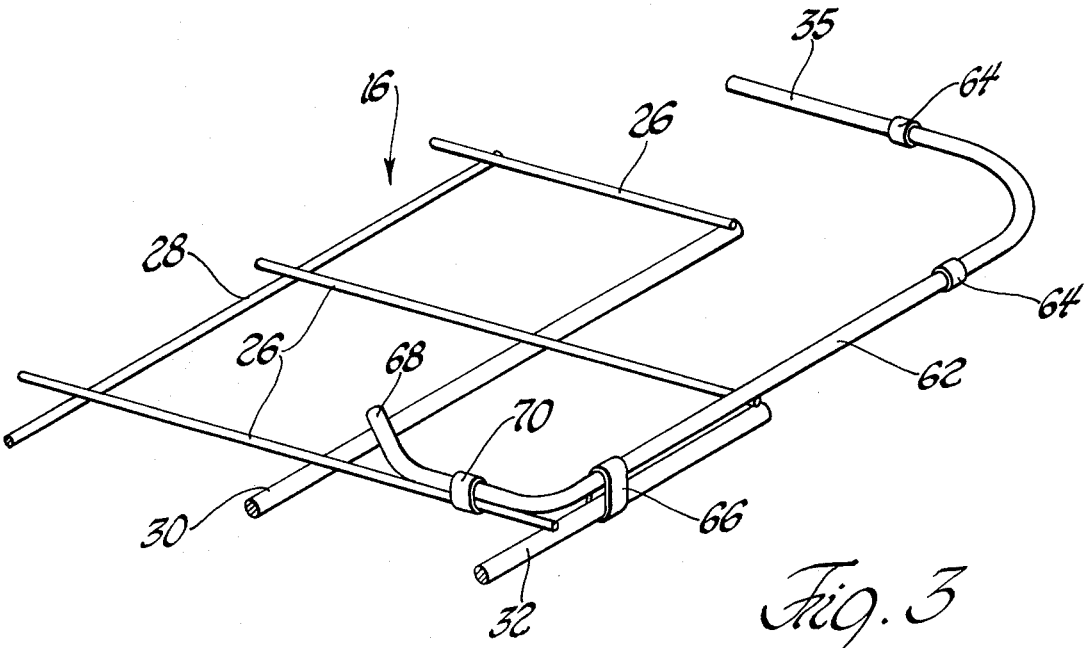
FIG. 3 is a perspective view of a grid of the assembly showing its lateral edge portion at one of the longitudinal ends of the assembly.

As seen by combined reference to FIGS. 1 and 3, the end border wires 35 at each end of the box spring assembly 10 include bent end portions 62 that are joined to the laterally extending portion of the border wire by rounded corners. Clips 64 are utilized at these corners to secure corner springs that are not shown. Each border wire end portion 62 overlaps the adjacent end of its associated outboard heavier gauge wire 32, as best seen in FIG. 3, and is secured thereto by an associated clip 66. The end portion 62 extends parallel to the adjacent inboard wire 30 where it overlaps the outboard wire 32. The extreme ends 68 of each end border wire 35 are turned inwardly to overlie the adjacent inboard heavier gauge wire 30 and are secured to one of the laterally extending wires 26 by associated clips 70. The clipped and overlying end portions 62 of each end border wire 35 thus interconnect these border wires with the rest of the grid 16.

The formed wire springs 14*e* are mounted on the end frame members 20 by suitable staples or the like in the same manner the springs 14*s* are mounted on the side frame members 18. Clips 72 secure the end border wires 35 to the end portions 56 of the connecting sections 38 of springs 14*e* to thereby resiliently support the border wires. Clips 74 secure the main portions 54 of the connecting sections 38 on the same springs directly to the endmost laterally extending wire 26 at each end of the wire grid 16. The opposite lateral ends of the endmost wires 26 are welded to the inboard heavier gauge wires 30 which have a longer length than the outboard heavier gauge wires 32, these latter wires terminating at the second wire 26 adjacent each end of the grid as best seen in FIG. 3.

Conventional equipment for welding bedding wire grids incorporates cooperable pairs of electrodes that make two welds to adjacent wire junctures at the same time. The power output of each of these electrodes is the same and is best utilized to form welds of the same size at each electrode. This conventional equipment can be readily utilized to manufacture the grid 16 since the wires 26 have the same size junctures with each of the heavier gauge wires 30 and 32.

As seen in FIG. 1, the central formed wire springs 14*c* are mounted on the frame slats 22, preferably by staples which are not shown, with their fishmouth sections 36 opening outwardly toward the lateral edges of the assembly. Clips 76 secure the main portions 54 of the connecting sections 38 on these springs to associated longitudinally extending wires 28 of the grid 16. The central springs 14*c* are thus secured to and support the grid 16 resiliently at its central portion.

While a preferred embodiment of the box spring assembly has herein been described in detail, those skilled in the art will recognize various alternative designs and embodiments for practicing the present invention as defined by the following claims.

What is claimed is:

1. A box spring assembly comprising: a lower frame having lateral side members and longitudinal end members forming a rectangular configuration; a plurality of formed wire side springs mounted on the frame adjacent each lateral side member thereof; each of said side springs including a pair of fishmouth sections extending upwardly from the frame and a connecting section that interconnects the fishmouth sections above the frame; said connecting section of each spring having an inboard main portion and outboard end portions connected to opposite ends of the main portion; a grid of laterally and longitudinally extending wires that cross each other and are supported on the frame by said springs; said grid including lateral edges which each have a pair of longitudinally extending wires of a heavier gauge than the other wires of the grid; each heavier gauge wire being laterally spaced from the other adjacent heavier gauge wire so these wires assume inboard and outboard positions; and means securing one of the heavier gauge wires of each lateral grid edge to the connecting sections of the formed wire side springs mounted on the frame.

2. An assembly as in claim 1 wherein the securing means includes clips that secure the outboard end portions of the connecting section of each spring to the outboard heavier gauge wire.

3. An assembly as in claim 1 which includes a pair of end border wires respectively associated with the longitudinal end frame members and extending laterally between the heavier gauge wires at each lateral side of the grid, a plurality of formed wire end springs mounted on the frame adjacent each end member thereof and having a construction like the side springs, means securing the end border wires to the outboard end portions of the connecting sections of the adjacent end springs, and means securing the inboard main portion of the connecting section of the end springs to the adjacent endmost laterally extending wire of the grid.

4. An assembly as in claim 3 which includes clips securing each end border wire to the outboard heavier gauge wires and to a laterally extending wire of the grid.

5. An assembly as in claim 4 wherein the outboard heavier gauge wires are shorter than the inboard bent gauge wires, and the end border wires including bend end portions that overlap the ends of the outboard heavier gauge wires while extending parallel to the adjacent inboard heavier gauge wires.

6. A box spring assembly comprising: a lower frame having lateral side members and longitudinal end members forming a rectangular configuration; a plurality of formed wire end springs mounted on the frame adjacent each end member thereof; each of said springs including a pair of fishmouth sections extending upwardly from the frame and a connecting section that interconnects the fishmouth sections above the frame; a pair of end border wires supported by the connecting sections of the springs; a grid of laterally and longitudinally extending wires that cross each other; means securing the grid to the connecting section of the end springs; said grid including lateral edges that each have a pair of longitudinally extending wires of a heavier gauge than the other wires of the grid and these heavier gauge wires being laterally spaced at inboard and outboard locations; the end border wires having bent end portions that overlap the outboard heavier gauge wires and also having extreme ends that are turned to also overlie the inboard heavier gauge wires; and means securing the end portions of the end border wires to the grid.

7. An assembly as in claim 6 wherein the latter securing means includes clips that secure the end portions of each end border wire to the outboard heavier gauge wires and to one of the laterally extending wires of the grid.

8. An assembly as in claim 7 wherein the inboard heavier gauge wires are longer than the outboard heavier gauge wires.

9. An assembly as in claim 6 which includes a plurality of formed wire side springs mounted on the frame adjacent the side members thereof and having a construction like the end springs; and means securing one of the heavier gauge wires at each lateral edge of the grid to the connecting sections of the adjacent side springs.

10. A box spring assembly comprising: a lower frame having lateral side members and longitudinal end members forming a rectangular configuration; a plurality of formed wire side and end springs mounted on the frame adjacent each side and end member thereof; each of said springs including a pair of fishmouth sections extending upwardly from the frame and a connecting section that interconnects the fishmouth sections above the frame; said connecting section of each spring having an inboard main portion and outboard end portions connected to opposite ends of the main portion; a grid of laterally and longitudinally extending wires that cross each other; said grid including lateral edges which each have a pair of longitudinally extending wires of a heavier gauge than the other wires of the grid; each heavier gauge wire being laterally spaced from the other adjacent heavier gauge wire so these wires assume inboard and outboard positions; means securing one of the heavier gauge wires of each lateral grid edge to the connecting sections of the adjacent formed wire side spring; a pair of end border wires supported by the connecting sections of the formed wire end springs; each end border wire including bent end portions that overlap the outboard heavier gauge wires and have extreme ends that are turned to also overlie the inboard heavier gauge wires; means securing the end portions of the end border wires to the grid; and means securing the endmost laterally extending wires of the grid to the connecting sections of the formed wire end springs.

11. An assembly as in claim 10 which includes clips securing the outboard heavier gauge wire at each lateral side of the grid to the outboard end portions of the connecting sections of the side springs, and which also includes clips securing the bent end portions of each end border wire to the outboard heavier gauge wires of the grid and to one of the laterally extending wires of the grid.

12. An assembly as in claim 11 which includes clips securing the end border wires to the outboard end portions of the connecting sections of the end springs, and clips securing the endmost laterally extending wires of the grid directly to the inboard main portion of the connecting sections of the end springs.

* * * * *